US006080014A

United States Patent [19]

Steiler

[11] Patent Number: 6,080,014

[45] Date of Patent: Jun. 27, 2000

[54] TRAILER CIRCUIT CONNECTOR MOUNT

[76] Inventor: Richard W. Steiler, 28395 Carriage Hill Dr., Highland, Calif. 92346

[21] Appl. No.: 09/088,402

[22] Filed: Jun. 1, 1998

[51] Int. Cl.[7] ..... H01R 13/66

[52] U.S. Cl. ..... 439/574; 439/34; 248/214

[58] Field of Search ..... 439/34–36, 574; 248/214, 230.8, 219.4; 280/420, 422

[56] References Cited

U.S. PATENT DOCUMENTS

| | | | |
|---|---|---|---|
| 2,436,533 | 2/1948 | Thompson | 248/214 |
| 3,307,710 | 3/1967 | Negri | 248/214 |
| 3,915,476 | 10/1975 | Burkle | 439/34 |
| 5,288,094 | 2/1994 | Putnam | 439/35 |
| 5,913,787 | 6/1999 | Edwards | 248/300 |

OTHER PUBLICATIONS

6 & 7–Way Connector Mounting Box packaging; Draw–Tite, Canton, MI 1 p.; no date.

U–Haul Piggyback Connector Bracket packaging; U–Haul International, Phoenix, AZ; 2 pp. (front and back of packaging); Apr. 1993.

*Primary Examiner*—Gary F. Paumen
*Assistant Examiner*—Briggitte Hammond
*Attorney, Agent, or Firm*—Sheldon & Mak

[57] ABSTRACT

A trailer connector mount includes a main bracket having a pair of clamp flanges for placement against one surface of a tow vehicle support member; a rear wall having a first connector opening for receiving a first connector socket to be mounted thereto in spaced relation to the support member; a first side wall intersecting one of the clamp flanges at an included angle behind the support member being approximately 80°; a second side wall extending between the rear wall and the other clamp flange; and a fastener wall being coplanar with the main clamp flanges and having respective fastener openings therein. A connector socket is fastened to one of the rear wall and the first side wall and projects toward the main clamping surface in spaced relation thereto. A pair of band clamps secure respective ones of the clamp flange portions to the support member. An auxiliary angle bracket is removably fastenable to the fastener wall of the main bracket and having orthogonal first and second flanges, the first flange having a pair of auxiliary clamp flange portions for spacing in line with respective ones of the main clamp portions, the second flange having a pair of fastener flange portions being formed in spaced relation to the auxiliary clamp flange portions for clearing the band clamps when the main clamp flange portions and the auxiliary flange portions are clamped against the support member by the band clamps.

22 Claims, 4 Drawing Sheets

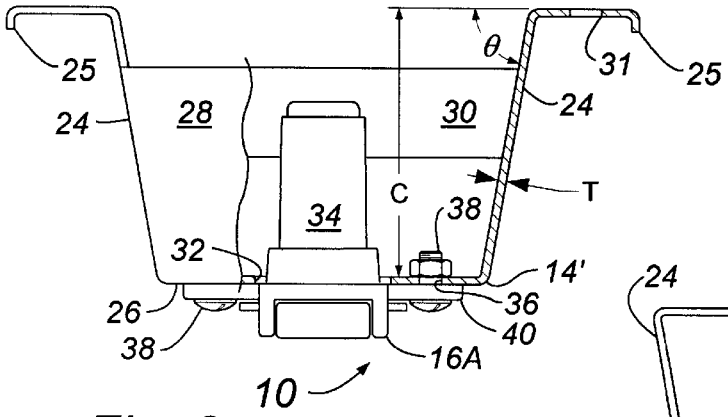
Fig. 3.
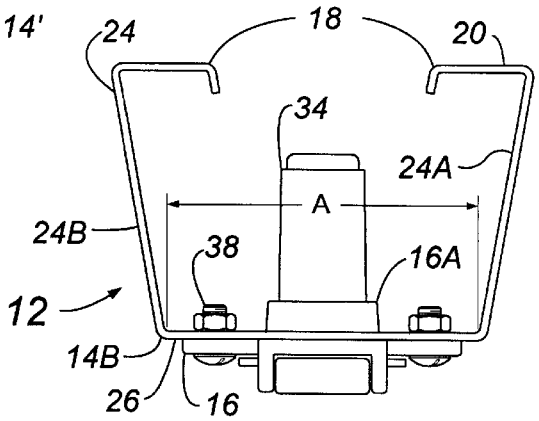
Fig. 4.
Fig. 7.
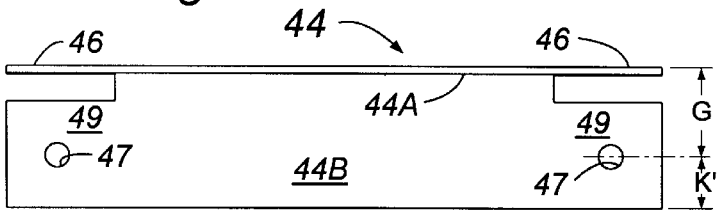
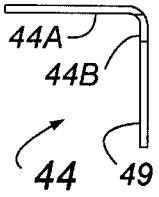
Fig. 8.
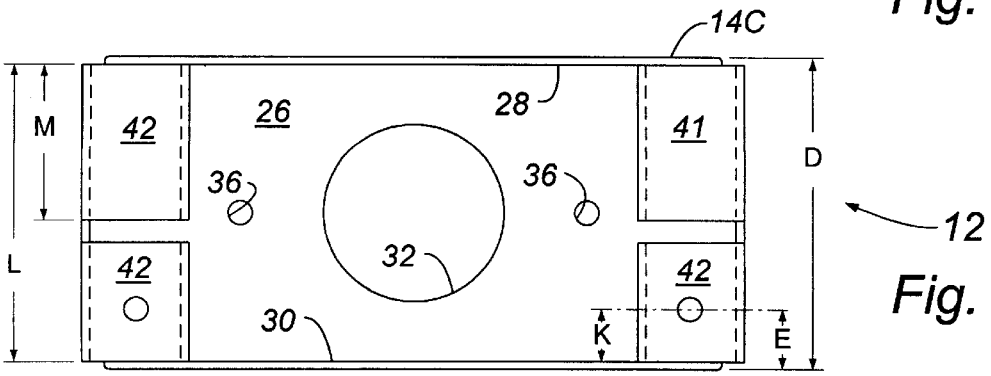
Fig. 5.

TRAILER CIRCUIT CONNECTOR MOUNT

BACKGROUND

The present invention relates to towed vechicle electrical connections, and more particularly to devices for anchoring connector components to a vehicle for facilitating selective coupling to another vehicle.

Trailer electrical connections range from the use of safety pins piercing wiring insulation of a towing vehicle and pigtail leads extending from the towed vehicle to custom mounting of a connector socket to vehicle structure such as a bumper for receiving a cable plug of the trailer, the socket being wired through a cable and harness connector to an existing connector of the vehicle wiring harness. In some cases, a connector pair of the vehicle harness is disconnected and the cable to the socket has counterparts of the connector pair that make substitute connections therebetween. Unfortunately, vehicle supporting structures such as bumpers are not standardized, nor are the connector sockets and plugs that complete the electrical path to the trailer. In fact, configurations of from four to seven pins in various sizes and geometric arrangements are in common use. This is because four moderately sized pins are sufficient for connection to most utility trailers (left turn, right turn, tail-marker, and ground), yet additional and larger pins are required for electrical trailer brakes and more pins are needed for accessory wiring that is commonly used in travel trailers.

As a result of the above, the art of making electrical connections between towed and towing vehicles is poorly developed, in that vehicle manufacturers that have control of supporting structure for electrical connections typically provide optional sockets in a single minimal configuration (four-pin in-line array). Aftermarket vendors of connectors in the various configurations merely furnish connector plugs and sockets either bare or with pigtail leads, but without support brackets because of the wide variations in the vehicle structures.

U.S. Pat. No. 5,288,094 to Putnam discloses a connector bracket that can be clamped onto a trailer hitch bar of rectangular cross-section. The bracket includes a hook-shaped plate having a U-shaped portion, one downwardly extending leg of which is elongated and having an opening for mounting a connector, and a securing device extending from proximate a lower extremity of the shorter leg to an intermediate location of the longer leg above the connector opening. The bracket is formed to fit top, front and rear surfaces of a rectangular tubular hitch mounting cross bar that is used in many trailer hitch installations. The securing device, disclosed as a pair of threaded fasteners, extends along a bottom surface of the cross bar. Although the disclosure of Putnam addresses some of the problems of the prior art, the bracket is not entirely satisfactory. For example:

1. The bracket has limited application, being formed to fit a singular cross bar rectangular section, whereas several sizes ranging from 2 inches square to approximately 3.5 inches square are commonly used;

2. The bracket is subject to damage in that the relatively weak longer leg and the connector socket necessarily projects below the cross bar where it can be struck by obstacles passing beneath the vehicle; and 3. The bracket is difficult to use in that it is somewhat difficult to reach, and it may need to be grasped and stabilized by hand to prevent bending while engaging or disengaging the trailer connector plug.

Thus there is a need for a trailer connector mount that overcomes the disadvantages of the prior art.

SUMMARY

The present invention meets this need. In one aspect of the invention, a trailer connector mount for a tow vehicle having a support member including an accessible portion of a uniform rectangular cross section, includes a main bracket including a main clamp flange portion defining a main clamping surface for placement against one surface of the support member; a planar first wall portion extending in spaced relation to the main clamping surface and having a first connector opening for receiving a first connector socket to be mounted thereto in spaced relation to the main clamping surface; and a band clamp for securing the main clamp flange portion against the support member.

The main clamp flange portion can be one of a pair of parallel spaced coplanar main clamp flange portions, the band clamp being one of a pair of band clamps for securing respective ones of the clamp flange portions to the support member. The main clamp flange portions can form outward lateral projections of the main bracket. Preferably the main clamp flange portions form inward lateral projections of the main bracket for locating the band clamps in partially concealed relation to the main bracket. Preferably each main clamp flange portion has a lip edge extremity projecting away from the main clamp surface for retaining the band clamp when the band clamp is not fully tightened against the main clamp flange portion.

The first wall portion can define a rear plane of the main bracket. The main bracket can further include a planar second wall portion defining a first side plane of the main bracket, the first side plane intersecting the rear plane of the main bracket, the second wall portion extending in spaced relation to the main clamping surface and having a second connector opening for receiving a second connector socket to be mounted thereto in spaced relation to the main clamping surface.

A connector assembly can include the connector mount in combination with first and second connector sockets fastened respectively to the first and second wall portions and projecting toward the main clamp surface in spaced relation thereto. Preferably the second wall portion intersects the main clamping surface at an included angle behind the second side plane being less than 90° for facilitating access to the second connector socket. Preferably the included angle is between approximately 70° and approximately 80°. More preferably, the included angle is approximately 80°. One of the main clamp flange portions can project from the second wall portion, the main bracket further including a planar third wall portion extending in spaced relation to the main clamping surface and defining a second side plane of the main bracket, the second side plane intersecting the rear plane of the main bracket. Alternatively, the first wall portion can define a side plane of the main bracket, the side plane intersecting the main clamping surface.

The connector mount can further include an auxiliary clamp flange portion spaced from the main clamp flange portion and projecting orthogonally thereto away from the first wall portion for contacting an intersecting surface of the support member. The main clamp flange portion can be one of a pair of parallel spaced coplanar clamp flange portions, the band clamp being one of a pair of band clamps for securing respective ones of the main clamp flange portions, and the auxiliary clamp flange portion being one of a pair of auxiliary clamp flange portions being spaced in line with respective ones of the main clamp flange portions for clamped engagement by corresponding ones of the band clamps when the band clamps are holding the main clamp flange portions against the support member. Preferably the auxiliary clamp flange portions are formed on an auxiliary bracket being removably fastenable to the main bracket for selectively locating the main bracket in downwardly projecting relation to the support member.

The auxiliary bracket can be an angle bracket having orthogonal flanges, the auxiliary clamp flange portions being formed in one of the flanges of the auxiliary bracket, a pair of fastener flange portions being formed in the other of the flanges in spaced relation thereto for clearing the band clamps when the main clamp flange portions and the auxiliary flange portions are clamped against the support member by the band clamps, the main bracket having a fastener wall portion being coplanar with the main clamp flange portions and having respective fastener openings therein for connecting the fastener flanges of the auxiliary bracket.

The connector mount can be assembled in combination with a connector socket being fastened to the first wall portion and projecting toward the main clamp surface in spaced relation thereto.

In another aspect of the invention, a method for mounting a trailer connector to a tow vehicle having a hitch support member of rectangular cross section includes the steps of:

(a) providing a bracket having a parallel spaced pair of coplanar clamp flanges and a first wall portion being spaced from the plane of the clamp flanges;

(b) fastening the trailer connector to the first wall portion, a portion of the connector projecting between the first wall portion and the plane of the clamp flanges;

(c) placing the clamp flanges against one face of the support member;

(d) coupling a pair of band clamps about the support member and enclosing respective ones of the clamp flanges; and (e) tightening the band clamps for clamping the clamp flanges against the support member.

DRAWINGS

These and other features, aspects, and advantages of the present invention will become better understood with reference to the following description, appended claims, and accompanying drawings, where:

FIG. 3 is a plan view showing an alternative configuration of the connector assembly of FIG. 1;

FIG. 4 is a plan view showing another alternative configuration of the assembly of FIG. 1;

FIG. 5 is a front elevational view showing an alternative configuration of a main bracket of the connector assembly of FIG. 1;

FIG. 7 is a front elevational view of an auxiliary bracket for use with the main bracket of FIG. 5;

FIG. 8 is a right side view of the auxiliary bracket of FIG. 7;

DESCRIPTION

Figure 1:
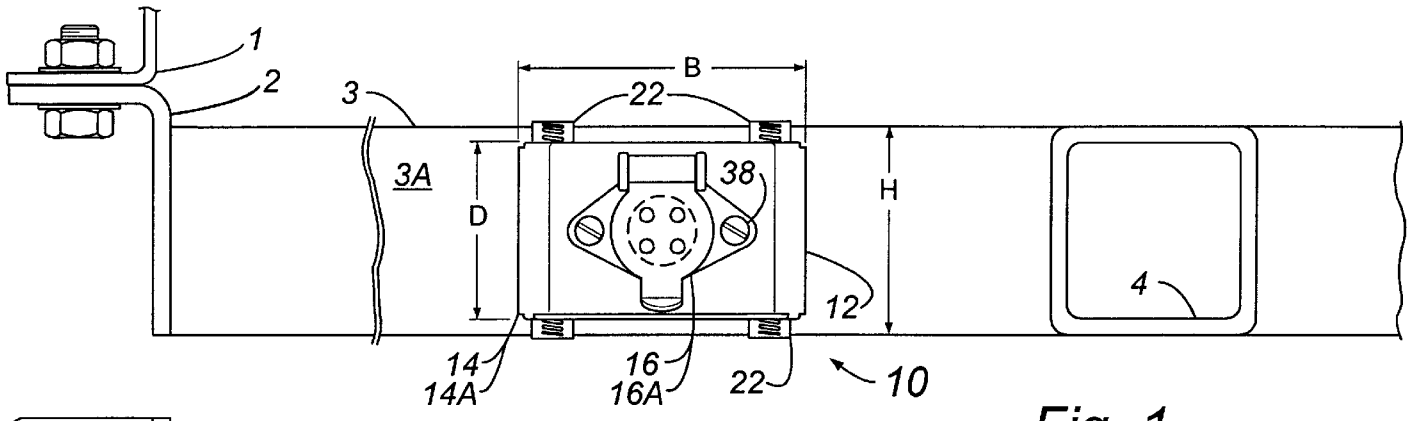
FIG. 1 is a rear elevational view of a vehicle trailer hitch structure having a trailer circuit connector assembly mounted thereto according to the present invention.
Figure 2:
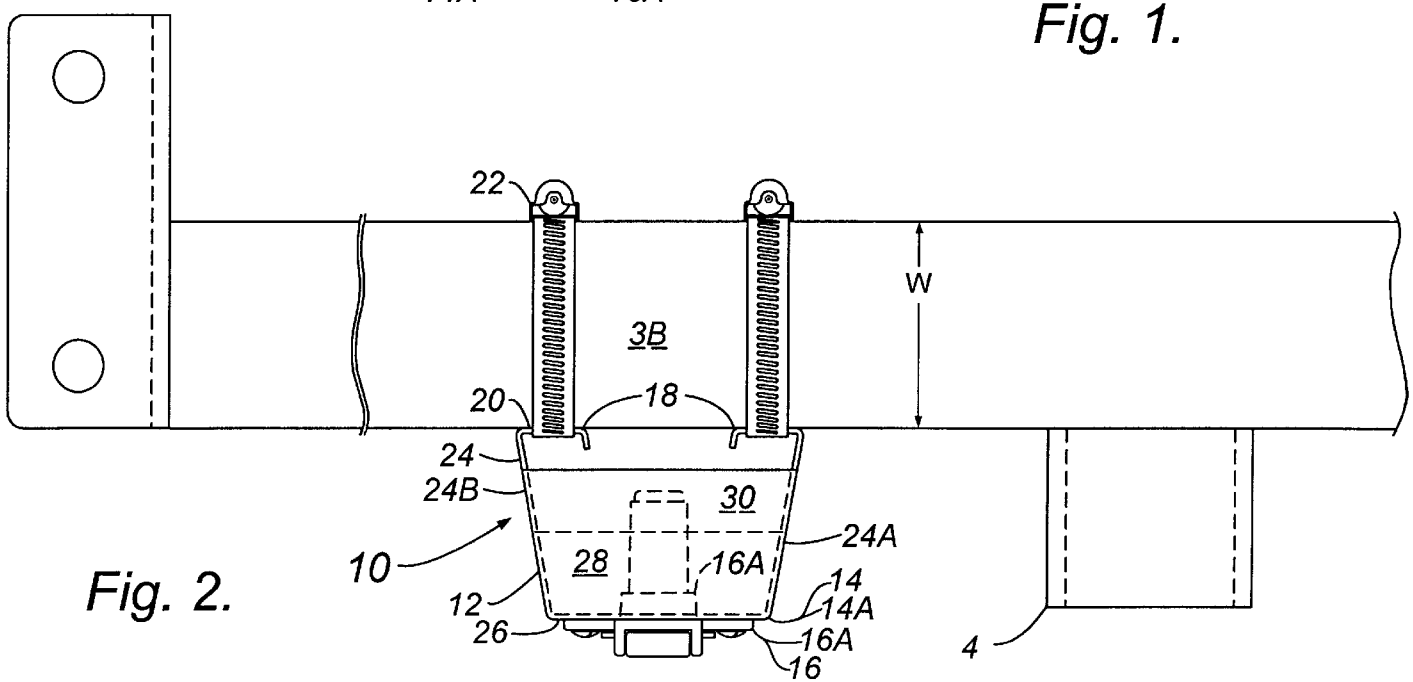
FIG. 2 is a plan view of the hitch structure and connector assembly of FIG. 1.

The present invention is directed to an electrical connector unit that is particularly effective in facilitating electrical connections between towed and towing vehicles. With reference to FIGS. 1 and 2 of the drawings, a trailer connector assembly 10 includes a connector mount 12 having a main bracket 14 to which is fastened a connector shell or socket 16, the mount 12 being adapted for anchoring to a tow vehicle 1 as described herein. FIG. 1 shows a hitch mount 2 connected to the vehicle 1 in a conventional manner (only a frame member portion of the vehicle being shown), the hitch mount 2 including a support member 3 that typically has a conventional hitch receiver 4 projecting rearwardly therefrom as best shown in FIG. 2. The support member 3, which is sometimes referred to as a cross bar, is normally formed of steel tubing having a generally rectangular cross section, being typically square with rounded corners, with outside dimensions including a width W and a height H being from approximately 2 inches to approximately 3.5 inches.

According to the present invention, the main bracket 14 includes a mounting clamp flange 18 that defines a planar main clamp surface 20, the assembly 10 also including a band clamp 22 for securing the flange 18 with the main clamp surface against a rear face 3A of the support member 3. Preferably the mounting clamp flange 18 is one of a parallel spaced coplanar pair of flanges 18, the assembly 10 including two of the band clamps 22 for more securely clamping the main bracket 14 to the support member 3 by both of the flanges 18. The mounting clamp flanges 18 are vertically oriented, and extend laterally from respective side walls 24 of the main bracket 14, each flange having a reinforcing lip 25, the lip 25 also advantageously retaining the corresponding band clamp 22 in place when same is not in a fully tightened condition.

The side walls are individually designated right wall 24A and left wall 24B. The main bracket 14 also includes a rear wall 26, a top wall 28, and an optional bottom wall 30, the bracket having an overall depth D and a base width B at front extremities of the side walls 24. The side walls 24, the rear wall 26 and the top wall 28 are smoothly joined along intersecting surfaces thereof for forming a rigid structure that is pleasing in appearance. In the exemplary configuration of main bracket, also designated 14A in FIGS. 1 and 2, the clamp flanges 18 face inwardly for locating the band clamps 22 between the side walls 24, further enhancing the appearance of the installed. connector assembly 10. The top and bottom walls 28 and 30 are foreshortened, being spaced from the reinforcing lips 25 for facilitating assembly of the band clamps 22. Also, the bottom wall 30 is preferably not connected to the rear wall 26, thereby affording access to interior portions of the bracket 14 to facilitate assembly with the connector socket 16. As shown in FIG. 2, respective screw mechanisms of the band clamps 22 are located opposite the rear face 3A of the support member 3. It will be understood that other orientations are possible, including location against the mounting clamp flanges 18, within the main bracket 14.

The connector assembly 10 in the configuration of FIGS. 1 and 2 is particularly advantageous in that the main bracket 14A does not project below the support member 3; the assembly can be positioned in any desired location along the member 3; and the band clamps 22 allow for the support member 3 to be variously sized in both of the section height H and the section width, within the limitation that the vertical depth D of the main bracket 14A not exceed the section height H. The connector socket, also designated 16A in FIGS. 1 and 2, is depicted as a conventional four-pin device that is available in standard metal and plastic versions from a variety of sources. It will be understood that other standard plug configurations are contemplated for use in the main bracket 14A configuration of FIGS. 1 and 2, examples of such connectors being described below in connection with FIGS. 9, 11 and 12.

With further reference to FIG. 3, an alternative configuration of the main bracket, designated 14', has the mounting clamp flanges 18 turned outwardly, each of the clamp flanges having a clamp fastener opening 31 formed therein for facilitating mounting against any suitable structure of the vehicle 1 using conventional screw fasteners (not shown). The clamp flanges are also adapted for receiving the band clamps 22 as described above, but spaced outwardly of the side walls 24. In each of the configurations described herein the side walls 24 intersect the main clamp surface 20 at an angle θ that is preferably less than 90° for producing a rearwardly tapered plan profile of the main bracket 14, and for reasons further developed below. The main clamp flanges 18 are sufficiently wide for receiving the adjustable band clamps 22, the lip 25 being typically spaced approximately 0.75 inch from the associated side wall 24. The clamp flanges 18, the side walls 24 and the rear wall 26 are integrally formed of a rigid sheet material having a thickness T. Typically, the material is a steel alloy, the tip and walls 28 and 30 being formed of like material and rigidly connected by suitable means such as welding. Alternatively, the main bracket 14 can be cast from metal or molded from a high-strength polymer that may be reinforced by fibrous elements in any suitable manner.

As further shown in FIG. 3, a planar portion of the rear wall 26 has a clearance opening 32 for receiving a body portion 34 of the connector socket 16A, a plurality of socket fastener openings 36 being formed in spaced relation to the opening 32 for receiving respective conventional flange fasteners 38 that can be screws, rivets, or the like by which a flange portion 40 of the socket 16A is anchored to the main bracket 14. In these respects, the main bracket 14' corresponds to the main bracket 14A of FIGS. 1 and 2.

With further reference to FIG. 4, another alternative configuration of the main bracket, designated 14B, has the top wall 28 and the bottom wall 30 omitted, being otherwise formed as described above in connection with FIGS. 1 and 2. The configuration of FIG. 3 is particularly advantageous for low cost fabrication in applications not requiring maximum strength and rigidity.

With further reference to FIG. 5, optional yet important feature of the present invention provides a more versatile attachment to the support member 3, the main bracket in another alternative configuration being designated 14C. More particularly, the clamping flanges 18, having an overall vertical length L, are split for forming an upper main portion 41 having a vertical length M, and an auxiliary portion 42 that is vertically spaced below the main portion 41. The length L normally corresponds to a height of the side walls 24 and/or the rear wall 26, being the same or slightly less than the vertical depth D of the main bracket 14. Thus each band clamp 22 can engage the principal flange portion 41 only, extending between the principal portion 41 and the auxiliary portion 42 to beneath the bottom face 3B of the support member 3 when the section height H is less than the length L, or when it is otherwise desired to have the main bracket 14 extend below the support member 3. For example, the vehicle 1 may be configured with limited clearance above and behind the support member 3. It will be understood that the principal and auxiliary portions 41 and 42 can be reversed when it is desired to locate the connector mount 12 with the main bracket 14 extending above the support member 3.

Figure 6:
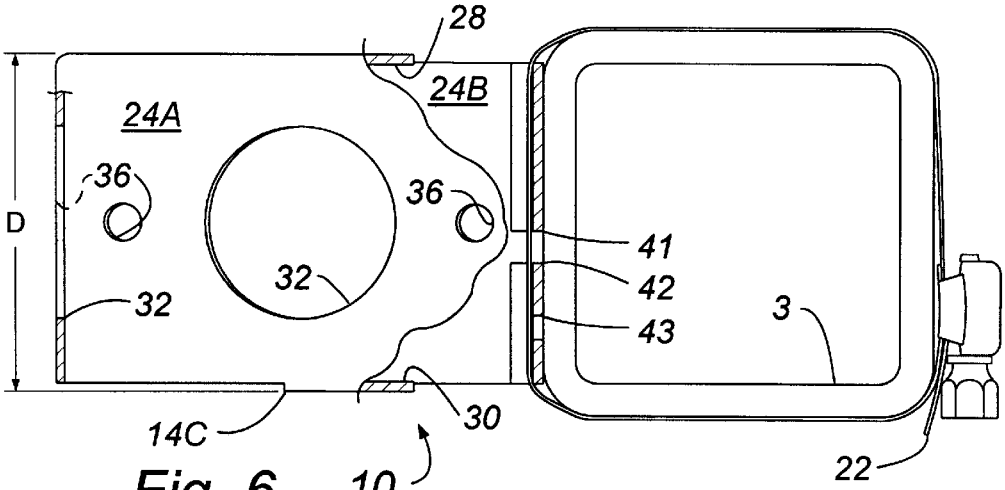
FIG. 6 is a right side elevational view of the connector assembly of FIG. 1 having the main bracket of FIG. 5 mounted to the trailer hitch structure.

In the preferred configuration of FIG. 5, and with further reference to FIG. 6, the auxiliary flange portions 42 are coplanar with the principal flange portions 41. Thus the band clamps 22 can selectively extend between the flange portions 41 and 42 as described above, or to enclose both the principal and auxiliary portions 41 and 42, with simultaneous clamping contact of the portions 41 and 42 against the support member 3 as shown in FIG. 6. In FIG. 6, a planar portion of the right wall 24A has counterparts of the clearance opening 32 and the fastener openings 36 as further described below. The auxiliary flange portions 42 have fastener openings 43 therein as shown in FIG. 5 for mounting an auxiliary bracket as described below.

Figure 10:
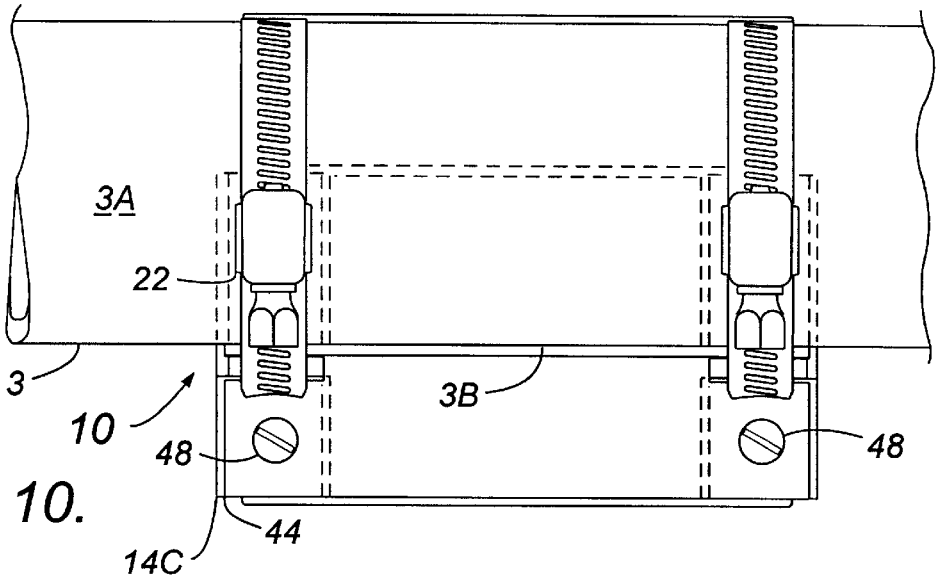
FIG. 10 is a front elevational view of the connector assembly and hitch structure combination of FIG. 9.
Figure 9:
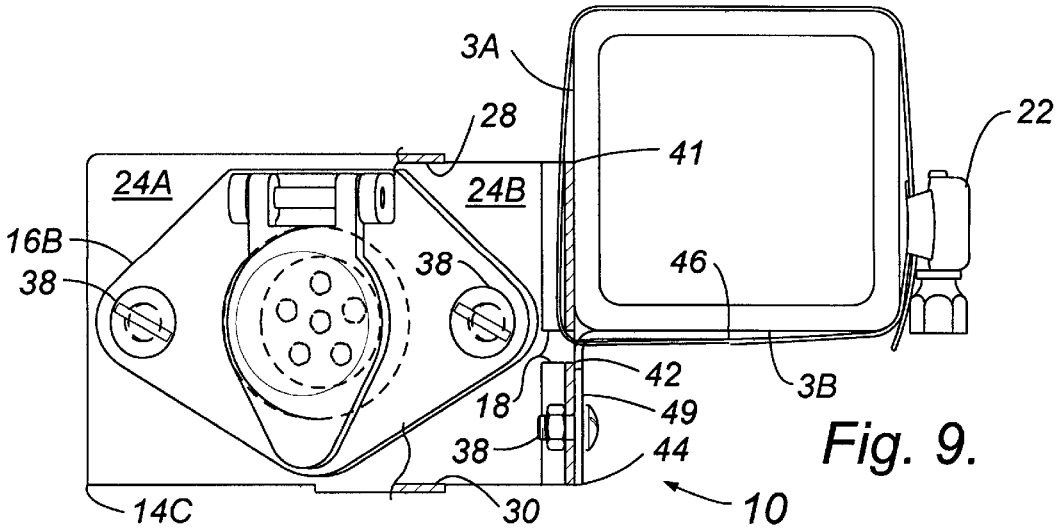
FIG. 9 is a right side view as in FIG. 6, showing the connector assembly including the auxiliary bracket of FIG. 7 and mounted in an offset relation to the trailer hitch structure.

With further reference to FIGS. 7–10, the connector assembly 10 of the present invention provides an optional auxiliary bracket 44 having auxiliary flange portions 46 for contacting the bottom face 3B of the support member 3, the band clamps 22 further enclosing the auxiliary flange portions 46 as shown in FIGS. 9 and 10 for enhanced stability of the connection of the connector mount 12 to the support member 3. An exemplary configuration of the auxiliary bracket 44 is formed as an angle bracket having orthogonal flanges 44A and 44B, the auxiliary flange portions 46 being located in the flange 44A at opposite end extremities thereof. The flange 44B has a spaced pair of fastener openings 47 for mounting to the main bracket 14, using counterparts of the fasteners 38, designated auxiliary fasteners 48, the fasteners 46 also engaging the openings 43 of the main bracket 14. The openings 47 are located in fastener flange portions 49 of the flange 44B, the respective flange portions 48 and 49 being spaced apart for permitting the band clamps 22 to extend therebetween.

As described above, counterparts of the clearance opening 32 and the fastener openings 26 can be formed in either or both of the side walls 24 and/or the rear wall 26 of the main bracket 14. FIG. 9 shows the connector assembly 10 including a counterpart of the connector socket, designated 16B, depicted as a conventional six-pin device that is available in standard metal and plastic versions from a variety of sources.

Figure 11:
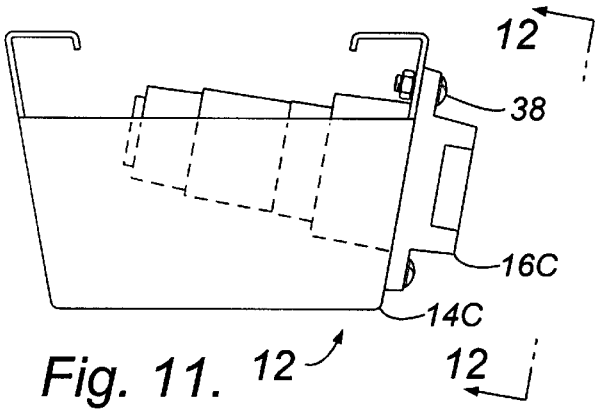
FIG. 11 is a plan view showing another alternative configuration of the connector assembly of FIG. 1.
Figure 12:
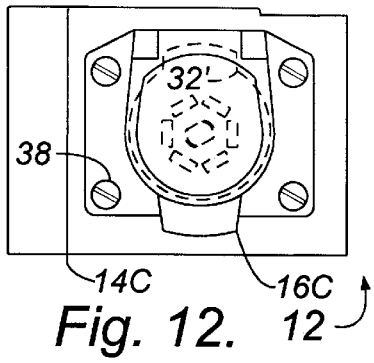
FIG. 12 is an oblique side elevation of the assembly of FIG. 11 on line 12—12 therein.

With further reference to FIGS. 11 and 12, the connector mount 12 can be configured for receiving a heavy-duty seven-pin connector socket, designated 16C. The main bracket 14C has the right side wall 14A formed for receiving four of the socket flange fasteners 38, a counterpart of the clearance opening, designated 32', having an enlargement for clearing a protrusion that is typically present in the heavy-duty connector socket 16C.

Figure 13:
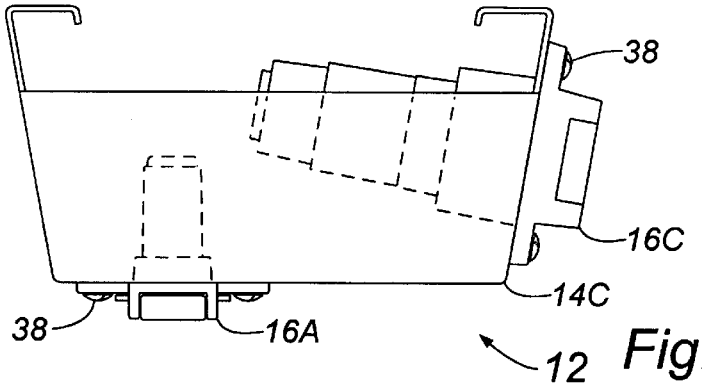
FIG. 13 is a plan view as in FIG. 11, showing a further alternative configuration of the assembly including a pair of connectors.
Figure 14:
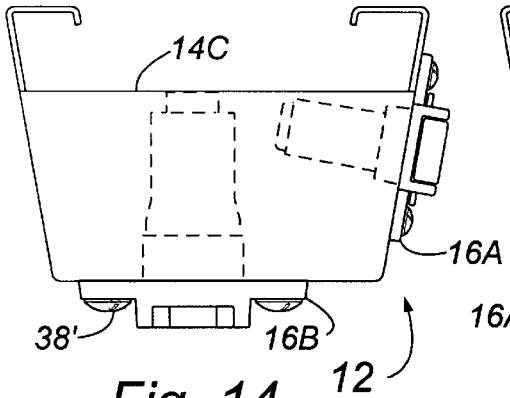
FIG. 14 is a plan view showing an alternative configuration of the assembly of FIG. 13.
Figure 15:
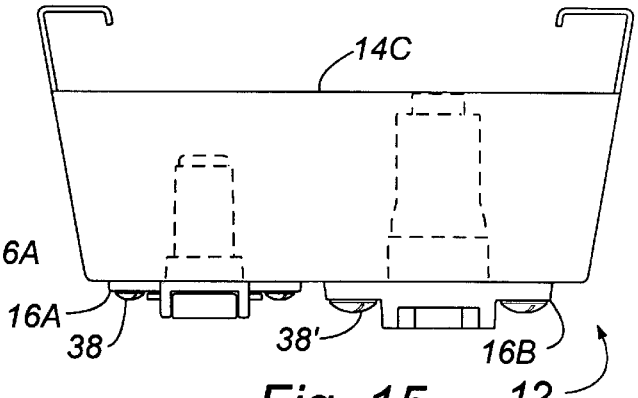
FIG. 15 is a plan view showing alternative configuration of the connector assembly of FIG. 14.

With further reference to FIGS. 13–15, multiple counterparts of the socket 16 can be anchored to the bracket 14. In each case, the main bracket is designated 14C for indicating the presence of the top and bottom walls 28 and 30, and the principal and auxiliary flange portions 41 and 42 of the main clamp flanges 18. It will be understood that variations as described above in connection with FIGS. 1, 3, and 4 (brackets 14A, 14', and 14B) are also contemplated. FIG. 13 shows a connector socket 16A rear-mounted and a connector socket 16C side-mounted. FIG. 14 shows a connector socket 16A side-mounted and a connector socket 16B rear-mounted; and FIG. 15 shows connector socket 16A and 16B both rear mounted. It will be further understood that plural connector socket 16 can be vertically offset as well as being horizontally aligned, the vertically offset alternative typically permitting a more compact arrangement when the connectors are of disparate sizes. In each of the variations of FIGS. 13–15, the connector socket 16 are different configurations. Thus a preferred configuration of the main bracket 14 can selectively receive differently configured counterparts of the connector socket 16 as well as being actually provided therewith. Accordingly, the tow vehicle 1 can be set up for selective coupling to different towed vehicles (not shown) having mating counterparts plugs of two or more of the connector sockets 16A, 16B and 16C, respectfully, without having to either exchange connector sockets 16 in the assembly 10 or to modify electrical connections between the sockets 16 and the vehicle 1.

Advantageously, the right wall 24A tapers rearwardly inwardly at the angle θ being less than 90° from the main clamping surface 20 as described above for enhancing access to the connector socket 16 being mounted to the side wall 24 as in FIGS. 9 and 12–14. Preferably the angle θ is approximately 80°. Also, the openings 32 and 36 are spaced sufficiently from the main clamp flanges 18 for locating the connector socket 16, including the inwardly extending body portion 34 thereof, in spaced relation to the support member 3, thereby to allow for the passage of electrical conductors connecting the socket 16 to existing wiring of the vehicle 1. Similarly, the rear wall 26 is sufficiently spaced from the main clamping surface 20 for accommodating a connector socket 16 when mounted thereto in spaced relation to the other connector socket 16 on the side wall 24 in addition to being spaced from the main clamping surface 20. It will be understood that in embodiments not having a connector socket 16 on a side wall 24, the connector socket 16 on the rear wall 26 need only be spaced from the side walls 24 and the main clamping surface 20; conversely, in embodiments not having the connector socket 16 on the rear wall 26, the rear wall 26 need only be spaced from the connector socket 16 on the side wall 24. Further in each of the exemplary configurations of the drawings, the rear wall 26 is approximately parallel spaced from the main clamping surface 20, although other orientations such as downwardly and rearwardly sloping in elevation and rightly and forwardly tapering in plan are contemplated. Similarly, the top wall 28, being nominally orthogonal to the main clamping surface 20, can be oriented downwardly and rearwardly sloping in elevation.

Specific dimensional examples of the connector assembly 10 as described above are summarized below in Table 1. Typically, the clearance opening 32 has a diameter of approximately 1.06 inch for the connector socket 16A, and 1.50 inch for the connector socket 16B. The clearance opening 32' for the connector socket 16C can have a diameter of 2.00 inch, and an enlargement of approximately 0.15 inch radially outwardly and having a width of approximately 0.75 inch. The fastener openings 36 can have a diameter of approximately 0.18 inch for the connector sockets 16A and 16C, being spaced approximately 1.75 inches for the connector socket 16A and 2.87 inch for the connector socket 16B, the diameter being approximately 0.26 inch for the connector socket 16B. For the connector socket 16C, four of the openings 36 can be centered on a rectangular pattern having a width of approximately 2.25 inches and a height of approximately 1.50 inches. Connector sockets in each of the configurations designated 16A, 16B, and 16C are available from Joseph Pollak Corp. of El Paso, Tex., the heavy-duty seven-pin connector socket 16C being model 12-700 in metal, model 12-705 in plastic. Plastic versions of at least some of the connectors are available from CalTerm, Inc. of El Cajon, Calif. the connector socket 16A being included in a pre-wired kit No. 08044.

TABLE 1

| | Dimension (inches) | | | | | | | | | |
|---|---|---|---|---|---|---|---|---|---|---|
| Type | A | B | C | D | E | F | G | K | L | M |
| R4A | 2.56 | 3.13 | 2.25 | 2.13 | 1.06 | 3.94 | — | — | 2.0 | — |
| R4B | 2.63 | 3.50 | 2.25 | 2.13 | — | 2.56 | 0.68 | — | 2.0 | — |
| R4C | 2.63 | 3.5 | 2.25 | 2.13 | 0.44 | 2.56 | 0.68 | 0.38 | 2.0 | 1.0 |
| R6C | 4.25 | 5.5 | 3.56 | 2.63 | 0.5 | 4.68 | 0.75 | 0.44 | 2.5 | 1.37 |
| S6C | 3.25 | 4.75 | 3.81 | 2.63 | 0.5 | 3.68 | 0.75 | 0.44 | 2.5 | 1.37 |
| R4R6C | 6.69 | 8.06 | 3.56 | 2.56 | 0.5 | 7.06 | 0.75 | 0.44 | 2.5 | 1.37 |
| R4S6C | 3.25 | 4.63 | 3.75 | 3.13 | 0.5 | 3.68 | 0.75 | 0.44 | 3.0 | 1.87 |
| R4S6C | 2.56 | 5.44 | 3.87 | 2.63 | 0.5 | 4.5 | 0.75 | 0.44 | 2.5 | 1.37 |
| R6S4C | 5.25 | 6.56 | 3.56 | 2.63 | 0.5 | 4.06 | 0.75 | 0.44 | 2.5 | 1.37 |
| S7C | 3.75 | 5.0 | 3.56 | 3.13 | 0.5 | 4.06 | 0.75 | 0.44 | 3.0 | 1.87 |
| R4S7C | 5.25 | 6.5 | 3.56 | 3.13 | 0.5 | 5.68 | 0.75 | 0.44 | 3.0 | 1.87 |

In Table 1, specific examples of the assembly 10 are listed by "Type", wherein R4 stands for the four-pin connector socket 16A mounted on the rear wall 26, S7 stands for the heavy-duty seven-pin connector socket 16C mounted on the side wall 24A, and the suffix A, B, or C denotes the main bracket having the configuration 14A, 14B, or 14C. In each case, the main clamp flanges 18 can face inwardly as shown in FIGS. 1, 2, and 4–15, or outwardly as shown in FIG. 3. Also, the angle θ is 80°, except for type R4S6C wherein the angle θ is 70°.

The present invention thus provides a versatile solution to the problem of making electrical connections to towed vehicles. Installation is facilitated in that there is no need for special tools or custom fabrication of parts. The assembly is pleasing in appearance and can be easily repositioned after installation, and the strength of the hitch mount 2 is not compromised. The connector(s) and the wiring thereto are protected from the elements, and from damage by ground contact and/or flying rocks.

Although the present invention has been described in considerable detail with reference to certain preferred versions thereof, other versions are possible. For example, the main bracket 14 can have the connector socket 16 mounted to the left side wall 26B when it is desired to locate the assembly 10 to the right of the receiver 4 of the hitch mount 2. Also, the main clamp flanges 18 can be joined for facilitating manufacture of the main bracket 14 by molding or casting. Further, a removable or snap-on cover can be provided in addition to or in place of the bottom wall 30 for excluding matter such as mud and snow that might be kicked up by the vehicle 1, preferably with one or more small drain holes being formed herein or between the insert and the main bracket 14. Moreover, an adapter can be provided for use with the support member 3 being round tubing, the adapter having a curved surface for contacting the support member, and a flat surface for placement of the main clamp flanges 18 Therefore, the spirit and scope of the appended claims should not necessarily be limited to the description of the preferred versions contained herein.

What is claimed is:

1. A trailer connector mount for a tow vehicle having a support member, a portion of the support member being accessible and having a uniform rectangular cross section, the mount comprising:

(a) a main bracket including (i) a mounting flange portion defining a main clamping surface for placement against one surface of the support member;

(ii) a planar first wall portion extending in spaced relation to the main clamping surface and having a first connector opening for receiving a first connector socket to be mounted thereto in spaced relation to the main clamping surface; and (b) a band clamp for securing the mounting flange portion against the support member, wherein a portion of the mounting flange portion projects laterally coplanar with the main clamping surface for receiving the band clamp in a coupled condition thereof and loosely enclosing the support member when the main bracket is located with the main clamping surface facing proximate the one surface of the support member.

2. The connector mount of claim 1, wherein the first wall portion defines a side plane of the main bracket, the side plane intersecting the main clamping surface.

3. A connector assembly comprising the connector mount of claim 1 in combination with a connector socket being fastened to the first wall portion and projecting toward the main clamp surface in spaced relation thereto.

4. The connector mount of claim 1, wherein the mounting flange portion is one of a pair of parallel spaced coplanar mounting flange portions, and the band clamp is one of a pair of band clamps for securing respective ones of the clamp flange portions to the support member.

5. The connector mount of claim 4, wherein the mounting flange portions form outward lateral projections of the main bracket for facilitating engagement by the band clamps.

6. The connector mount of claim 4, wherein the mounting flange portions form inward lateral projections of the main bracket for locating the band clamps in partially concealed relation to the main bracket.

7. The connector mount of claim 4, wherein each mounting flange portion has a lip edge extremity projecting away from the mounting surface for retaining the band clamp when the band clamp is not fully tightened against the mounting flange portion.

8. The connector mount of claim 1, wherein the first wall portion defines a rear plane of the main bracket.

9. The connector mount of claim 8, wherein the main bracket further includes a planar second wall portion defining a first side plane of the main bracket, the first side plane intersecting the rear plane of the main bracket, the second wall portion extending in spaced relation to the main clamping surface and having a second connector opening for receiving a second connector socket to be mounted thereto in spaced relation to the main clamping surface.

10. A connector assembly comprising the connector mount of claim 9 in combination with first and second connector sockets being fastened respectively to the first and second wall portions and projecting toward the mounting surface in spaced relation thereto.

11. The connector mount of claim 9, wherein the second wall portion intersects the main clamping surface at an included angle behind the first side plane being less than 90° for facilitating access to the second connector socket.

12. The connector mount of claim 11, wherein the included angle is between approximately 70° and approximately 80°.

13. The connector mount of claim 11, wherein the included angle is approximately 80°.

14. A trailer connector mount for a tow vehicle having a support member, a portion of the support member being accessible and having a uniform rectangular cross section, the mount comprising:

(a) a main bracket including (i) a mounting flange portion defining a main clamping surface for placement against one surface of the support member;

(ii) a planar first wall portion extending in spaced relation to the main clamping surface and having a first connector opening for receiving a first connector socket to be mounted thereto in spaced relation to the main clamping surface;

(b) a band clamp for securing the mounting flange portion against the support member; and (c) an auxiliary flange portion spaced from the mounting flange portion and projecting orthogonally thereto away from the first wall portion for contacting an intersecting surface of the support member.

15. A connector assembly comprising the connector mount of claim 14 in combination with a connector socket being fastened to the first wall portion and projecting toward the main clamp surface in spaced relation thereto.

16. The connector mount of claim 14, wherein the mounting flange portion is one of a pair of parallel spaced coplanar mounting flange portions, the band mounting is one of a pair of band clamps for securing respective ones of the mounting flange portions, and the auxiliary clamp flange portion is one of a pair of auxiliary clamp flange portions being spaced in line with respective ones of the mounting flange portions for clamped engagement by corresponding ones of the band clamps when the band clamps are holding the mounting flange portions against the support member.

17. The connector mount of claim 16, wherein the auxiliary clamp flange portions are formed on an auxiliary bracket being removably fastenable to the main bracket.

18. The connector mount of claim 17, wherein the auxiliary bracket is an angle bracket having orthogonal flanges, the auxiliary clamp flange portions being formed in one of the flanges of the auxiliary bracket, a pair of fastener flange portions being formed in the other of the flanges in spaced relation thereto for clearing the band clamps when the mounting flange portions and the auxiliary flange portions are clamped against the support member by the band clamps, the main bracket having a fastener wall portion being coplanar with the mounting flange portions and having respective fastener openings therein for connecting the fastener flanges of the auxiliary bracket.

19. A trailer connector mount for a tow vehicle having a support member, a portion of the support member being accessible and having a uniform rectangular cross section, the mount comprising:

(a) a main bracket including (i) a pair of parallel spaced coplanar mounting flange portions defining a main clamping surface for placement against one surface of the support member;

(ii) a planar rear wall portion extending in spaced relation to the main clamping surface and having a first connector opening for receiving a first connector socket to be mounted thereto in spaced relation to the main clamping surface;

(iii) a planar first side wall portion, the first side wall portion intersecting the main clamping surface at an included angle behind the second side plane being approximately 80°, one of the mounting flange portions projecting from the first side wall portion;

(iv) a planar second side wall portion extending in spaced relation to the main clamping surface and defining a second side plane of the main bracket, the second side plane intersecting the rear wall portion of the main bracket, the other of the mounting flange portions projecting from the second side wall portion; and (v) a fastener wall portion being coplanar with the mounting flange portions and having respective fastener openings therein;

(b) a connector socket being fastened to one of the rear wall portion and the first side wall portion, the connector socket projecting toward the main clamping surface in spaced relation thereto;

(c) a pair of band clamps for securing respective ones of the mounting flange portions to the support member, the mounting flange portions forming inward lateral projections of the main bracket for locating the band clamps in partially concealed relation to the main bracket, each mounting flange portion having a lip edge extremity projecting away from the mounting surface for retaining the respective band clamp when the band clamp is not fully tightened against the mounting flange portion; and (d) an auxiliary bracket removably fastenable to the fastener wall portion of the main bracket, the auxiliary bracket being an angle bracket having orthogonal first and second flanges, the first flange having a pair of auxiliary flange portions for spacing in line with respective ones of the mounting flange portions and projecting orthogonally thereto away from the rear wall portion for contacting an intersecting surface of the support member for clamped engagement by corresponding ones of the band clamps when the band clamps are holding the mounting flange portions against the support member, the second flange having a pair of fastener flange portions being formed in spaced relation to the auxiliary flange portions for clearing the band clamps when the mounting flange portions and the auxiliary flange portions are clamped against the support member by the band clamps.

20. A method for mounting a trailer connector socket to a tow vehicle having a hitch support member of rectangular cross section, the method comprising the steps of:

(a) providing a bracket having a parallel spaced pair of coplanar mounting flanges and a first wall portion being spaced from the plane of the mounting flanges;

(b) fastening the trailer connector socket to the first wall portion, a portion of the connector socket projecting between the first wall portion and the plane of the mounting flanges;

(c) coupling a pair of band clamps loosely about the support member (d) placing the flanges against one face of the support member;

(e) laterally locating the band clamps in the coupled condition thereof in enclosed relation to respective ones of the flanges; and (f) tightening the band clamps for clamping the mounting flanges against the support member.

21. A trailer connector mount for a tow vehicle having a support member, a portion of the support member being accessible and having a uniform rectangular cross section, the mount comprising:

(a) a main bracket including (i) a parallel spaced coplanar pair of mounting flanges defining a main clamping surface for placement against one surface of the support member;

(ii) a planar rear wall portion extending in spaced relation to the main clamping surface;

(iii) a pair of side wall portions defining respective side planes of the main bracket, each of the mounting flanges projecting laterally from a corresponding one of the side walls, a connector opening being formed in one of the wall portions for receiving a connector socket to be mounted thereto in spaced relation to the main clamping surface; and (b) a pair of band clamps for securing respective ones of the mounting flanges against the support member, wherein respective portions of the mounting flanges project laterally coplanar with the main clamping surface for receiving the band clamps in coupled conditions thereof and loosely enclosing the support member when the main bracket is located with the main clamping surface facing proximate the one surface of the support member.

22. A connector assembly comprising the connector mount of claim 21 in combination with a connector socket being fastened to the one of the wall portions and projecting toward the main clamp surface in spaced relation thereto.

* * * * *